US006112349A

United States Patent [19]

Connolly

[11] Patent Number: 6,112,349

[45] Date of Patent: Sep. 5, 2000

[54] THERAPEUTIC DEVICE

[75] Inventor: Patrick Joseph Connolly, Athlone, Ireland

[73] Assignee: Alliance Investments Limited, Athlone, Ireland

[21] Appl. No.: 09/099,397

[22] Filed: Jun. 18, 1998

Related U.S. Application Data

[63] Continuation of application No. PCT/IE96/00087, Dec. 17, 1996.

[30] Foreign Application Priority Data

Dec. 18, 1995 [IE] Ireland ..... 950950

[51] Int. Cl.[7] ..... A61G 7/008

[52] U.S. Cl. ..... 5/607; 5/608; 5/610; 5/621; 5/430

[58] Field of Search ..... 5/607, 608, 609, 5/610, 621, 427, 428, 430

[56] References Cited

U.S. PATENT DOCUMENTS

| | | | |
|---|---|---|---|
| 2,429,834 | 10/1947 | Madden et al. | 128/33 |
| 3,210,778 | 10/1965 | Robinson | 5/430 X |
| 3,238,539 | 3/1966 | Koch | 5/61 |
| 3,434,165 | 3/1969 | Keane | 5/61 |
| 3,797,050 | 3/1974 | Benoit et al. | 5/610 |
| 3,827,089 | 8/1974 | Grow | 5/61 |
| 4,868,937 | 9/1989 | Connolly | 5/61 |
| 5,020,170 | 6/1991 | Ruf | 5/607 |
| 5,088,706 | 2/1992 | Jackson | 5/608 |
| 5,131,106 | 7/1992 | Jackson | 5/607 X |
| 5,502,853 | 4/1996 | Singleton et al. | 5/608 X |

FOREIGN PATENT DOCUMENTS

| | | |
|---|---|---|
| 0315438 | 5/1989 | European Pat. Off. . |
| WO96/27356 | 9/1996 | WIPO . |

*Primary Examiner*—Michael F. Trettel
*Attorney, Agent, or Firm*—Jacobson, Price, Holman & Stern, PLLC

[57] ABSTRACT

A therapeutic bed includes a castor support framework and a Trendelenburg support frame including curved arms which are mounted on guide rollers of the castor frame. The Trendelenburg support frame carries guide rollers on which rings at opposite ends of the bed run. A patient support platform is mounted on the rings. A patient supine support including a mattress and leg supports are mounted on the patient support platform. Side rails are engagable and lockable to the platform. A patient prone support includes a head support, an adjustable abdomen support and support pad sections which are each split longitudinally to define adjustable support parts which are hingedly mounted to the corresponding opposite side rails, engaged and locked in position. The therapeutic bed provides for prone positioning of a patient by rotation of the rings on the rollers through 180°. The bed may also be used for kinetic therapy and/or Trendelenburg motion when a patient is in the supine and/or prone position.

10 Claims, 8 Drawing Sheets

THERAPEUTIC DEVICE

This application is a continuation of PCT/IE96/00087 filed Dec. 17, 1996 which is based on Ireland application 950950 filed Dec. 18, 1995.

The invention relates to a therapeutic bed.

INTRODUCTION

Therapeutic beds in which a patient may be rotated about a longitudinal axis of rotation are known for example from U.S. Pat. No. 3,434,165 and U.S. Pat. No. 4,868,937. Such beds are used to laterally rotate the patient left and right. Clinical practice has indicated the efficacy of this therapy particularly in the treatment of patients with respiratory problems.

There is, however, a need for a therapeutic bed of this type in which the rotation is smooth, well balanced and controlled.

In addition, there is a requirement to physically position in a face down or prone position patients with severe respiratory problems—particularly patients with Adult Respiratory Distress Syndrome (ARDS). Such patients have a mortality of in excess of 70%. The ability to prone position these patients could determine their survival.

STATEMENTS OF INVENTION

According to the invention, there is provided a therapeutic bed comprising:

a base framework, a patient support platform mounted on the base framework, guide means on one of the patient support platform or framework for engagement with engagement means on the other of the patient support platform or framework for controlled rotational movement of the patient support platform relative to the base framework about a longitudinal axis of rotation of the patient support platform, the engagement means comprising rail means for engagement with the guide means on rotation of the patient support platform.

This arrangement of engagement means and guide means facilitates smooth controlled rotation of the bed. The rail means provides easy access to the patient particularly at the head end of the bed. In this way, the head of the patient may be easily accessed and various operations carried on the patient without requiring the patient to be moved.

In one particularly preferred embodiment of the invention, the rail means are provided at opposite ends of the patient support platform. This provides easy access to both the head and foot end of the patient and provides a balanced arrangement for ease of rotation and comfort of the patient.

In one embodiment of the invention, the guide means are of arcuate shape to conform with the rotational movement of the patient support platform. This arrangement facilitates ease of rotation and balance required for a patient.

In a preferred embodiment of the invention, the rail means are of ring shape. Such a shape provides an arc of rotation of up to 360°, i.e. 180° to the left and right which facilitates ease of access to the patient while providing a controlled well balanced and comfortable arrangement for rotating the patient.

In one embodiment of the invention, the guide means are roller guide means on the base framework on which the engagement means rotates on rotation of the patient support platform about the longitudinal axis of rotation.

Such roller guide means facilitates smooth controlled rotation of the patient support platform.

Preferably, at least some of the roller guide means are driven by a drive motor to rotate the patient support platform. This provides a relatively easy well balanced and controlled arrangement for rotating the patient particularly between a supine face-up position and a prone, face-down position.

In one embodiment of the invention which is suitable for kinetic therapy, the patient support platform is rotatable about a longitudinal axis of rotation through an angle of at least +40° to −40°, most preferably approximately +62° to −62° to the horizontal.

In a particularly preferred embodiment of the invention, the patient support platform is rotatable about the longitudinal axis through substantially 180° from a patient face-up or supine position to a patient face-down or prone position. This provides an arrangement by which the patient support platform may be readily easily rotated from a patient supine position to a patient prone position.

In one embodiment of the invention, the therapeutic bed includes prone patient support means for supporting the patient in the prone position, the prone patient support means being mounted for movement from a release position when a patient is in the supine position to an engaged position to support the patient in the prone position.

In a particularly preferred embodiment of the invention, the bed includes a pair of side rails extending from the patient support platform and at least a portion of the patient prone position support means is mounted on the side rails for movement between the released and engaged positions. This arrangement provides a particularly easy way of facilitating movement of the patient prone position support means.

In a particularly preferred embodiment of the invention the prone position support means includes a number of sections which are mounted on the side rails for movement between the release and engaged positions.

In an especially preferred embodiment of this aspect of the invention the prone patient support means includes opposite parts which are mounted on the opposed side rails, the opposite parts being lockable in the engaged position to at least partially define the prone patient support means. This arrangement is particularly advantageous in comfortably and easily supporting a patient in the prone position and particularly for accommodating patients of varying sizes and shapes. In this connection preferably some of the opposite parts are adjustable to accommodate different sized patients.

The opposites parts may be longitudinally adjustable along the side rails.

In one embodiment of the invention the opposite parts are engagable and lockable by a strap means having a fastener means. This arrangement is advantageous as it provides a recognisable and easily operated system for engaging and locking the prone patient support means in position.

For ease of assembly and operation the opposite parts are preferably hingedly mounted to the associated side rail for movement from the release position to the engaged position.

To facilitate the mounting of patients on the bed preferably the side rails are removable from the patient support platform. In this case preferably locking means are provided for locking the side rails to the patient support platform. This is an important safety feature to ensure that when the patient is in the prone position the side rails and associated supports are always in the correct engaged position.

In one embodiment of the invention the prone patient support means includes an abdomen support. Most preferably the abdomen support is adjustable to accommodate abdomens of varying sizes. This feature is particularly important as it will be appreciated that there are large variations in the size of the patient to be accommodated on such therapeutic beds and in particular the abdomen of such patients in many cases tends to be quite large and is an area that often causes most discomfort to such patients when in the prone position.

The abdomen support is preferably of a flexible material.

In one embodiment of the invention the patient support platform includes a patient supine support means and the abdomen support is mounted on the patient supine support means for movement from a release position to an engaged position. This arrangement is particularly suitable for mounting and adjusting the abdomen support in position.

In a typical arrangement the patient supine support means comprises a mattress and a pair of side supports extending upwardly from the mattress, the abdomen support being mounted on the or each side support.

In a particularly preferred embodiment of the invention the prone patient support means includes a separate head support. Again this is often an area of discomfort for patients in the prone position. To accommodate patients of varying head sizes the head support is preferably adjustable. Preferably the head support comprises a main head support and a pair of adjustable side support straps extending from the main head support. This arrangement facilitates supporting the patient's head in position while allowing sufficient flexibility for patient comfort. Preferably the side support straps are of a flexible material.

In one arrangement preferably the side support straps are mounted to the patient support platform.

In one embodiment of the invention the prone patient support means includes patient arm support means for comfortably supporting a patients arm in the supine position.

For patient comfort preferably the patient arm support means is of a flexible material.

For ease of manufacture and use typically the patient arm support means in mounted on the patient support framework.

In one particularly preferred embodiment of the invention the base framework comprises a castor frame and a Trendelenburg frame mounted on the castor frame, the patient support platform being mounted on the Trendelenburg frame and the Trendelenburg frame being mounted to the base frame for movement about a transverse axis of rotation. This arrangement not only provides for rotation of patient about a longitudinal axis but also Trendelenburg motion in which the patient is swung on a transverse axis of rotation.

In a preferred embodiment of the invention the Trendelenburg frame includes curved arm means engagable with Trendelenburg guide means on the castor frame. This arrangement provides a particularly smooth, comfortable and balanced bed which facilitates Trendelenburg motion.

Preferably the curved arm means comprises a pair of longitudinally extending transversely spaced-apart curved arms which are engagable with the Trendelenburg guide means.

For ease of Trendelenburg motion preferably the Trendelenburg guide means comprises Trendelenburg roller guide means on the base framework on which the curved arms move to achieve Trendelenburg motion.

Preferably the Trendelenburg frame is rotatable on operation of a Trendelenburg drive motor. In this case for ease of operation, and for a balanced and comfortable Trendelenburg motion preferably the drive motor drives at least some of the Trendelenburg roller guide means to achieve Trendelenburg motion.

In another aspect the invention provides a prone patient support comprising a pair of side rails which are spaced-apart to accommodate a patient therebetween, and a number of patient support sections defined by opposite support parts which are mounted on the opposed side rails for movement trom a release position to an engaged position for engaging and supporting a patient in the prone position, the opposite parts being mounted on the opposed side rails and being lockable in the engaged position to support a patient in the prone position. This arrangement is particularly advantageous in comfortably and easily supporting a patient in the prone position and particularly for accommodating patients of varying sizes and shapes.

In this case preferably the opposite parts are longitudinally adjustable along the side rails. This facilitates adjustment to accommodate patients of different size and shape.

Preferably the opposite parts are adjustable in the engaged position, prior to locking. This also facilitates adjustment to accommodate different patients.

Most preferably opposite parts are engagable and lockable by a strap means having a fastener means. This feature provides a recognisable and easily operated system for engaging and locking prone patient support means in position.

For ease of assembly and operation preferably the opposite parts are hingedly mounted to the associated side rail for movement from the release position to the engaged position.

Preferably the prone patient support means includes an abdomen support.

Preferably the abdomen support is adjustable to accommodate abdomen of varying sizes. This feature is particularly important as it will be appreciated that there are large variations in the size of the patient to be accommodated on such therapeutic beds and in particular the abdomen of such patients in many cases tends to be quite large and is an area that often causes most discomfort to such patients when in the prone position.

Preferably the abdomen support is of a flexible material.

In another particularly preferred embodiment of this aspect of the invention the prone patient support includes a head support. Again this is often an area of discomfort for patients in the prone position. To accommodate patients of varying head sizes the head support is preferably adjustable. Preferably the head support comprises a main head support and a pair of adjustable side support straps extending from the main head support. This arrangement facilitates supporting the patient's head in position while allowing sufficient flexibility for patient comfort. Preferably the side support straps are of a flexible material.

In another embodiment of this aspect of the invention the prone patient support includes patient arm support means for comfortably supporting a patients arms in the prone position.

In this case preferably the patient arm support means is of a flexible material.

In a particularly preferred arrangement each patient arm support means is mounted on the patient support framework.

BRIEF DESCRIPTION OF THE DRAWINGS

The invention will be more clearly understood from the following description thereof given by way of example only with reference to the accompanying drawings in which.

DETAILED DESCRIPTION OF THE INVENTION

Figure 1:
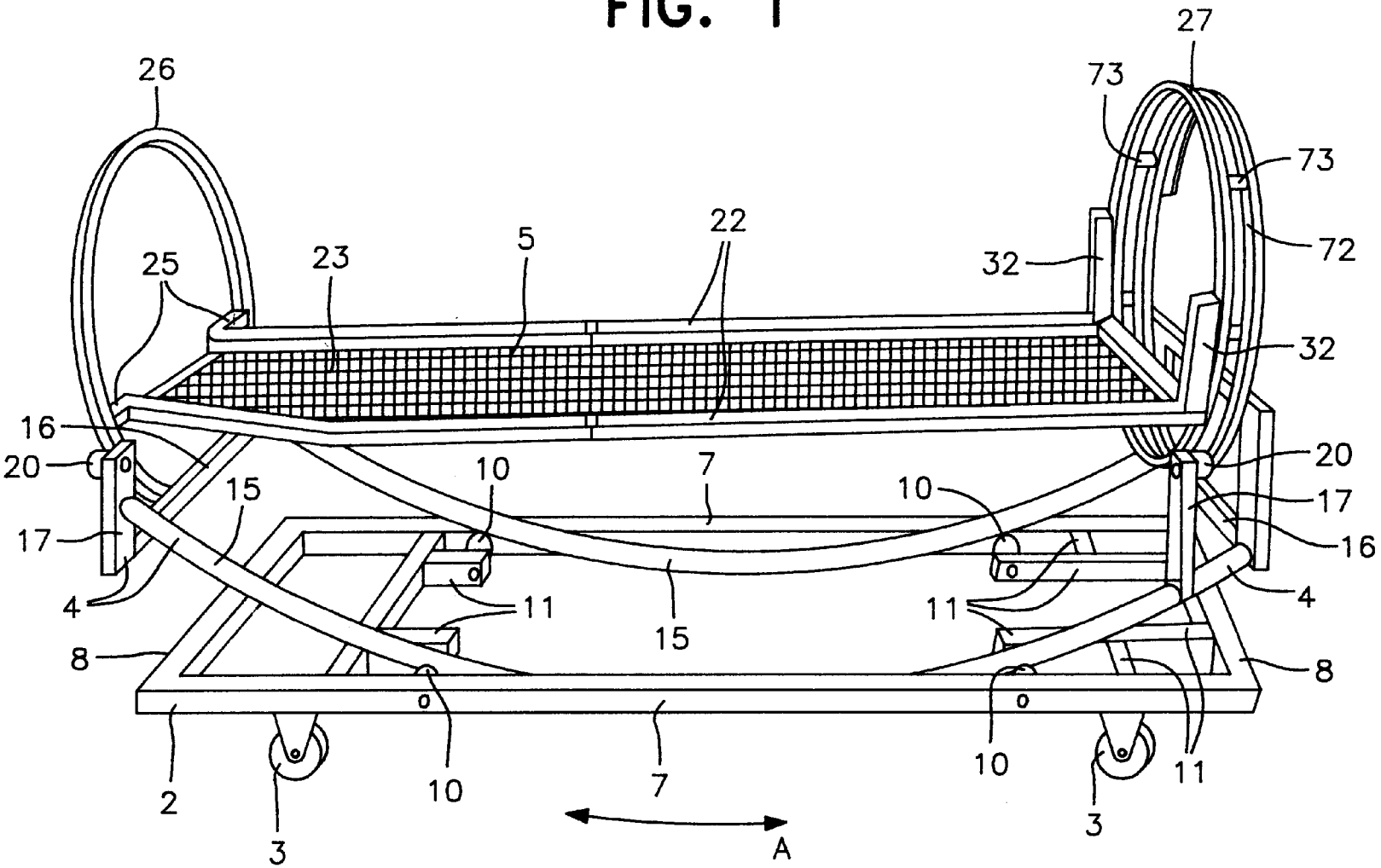
FIG. 1 is a perspective view of a part of a therapeutic bed according to the invention in one position of use.
Figure 2:
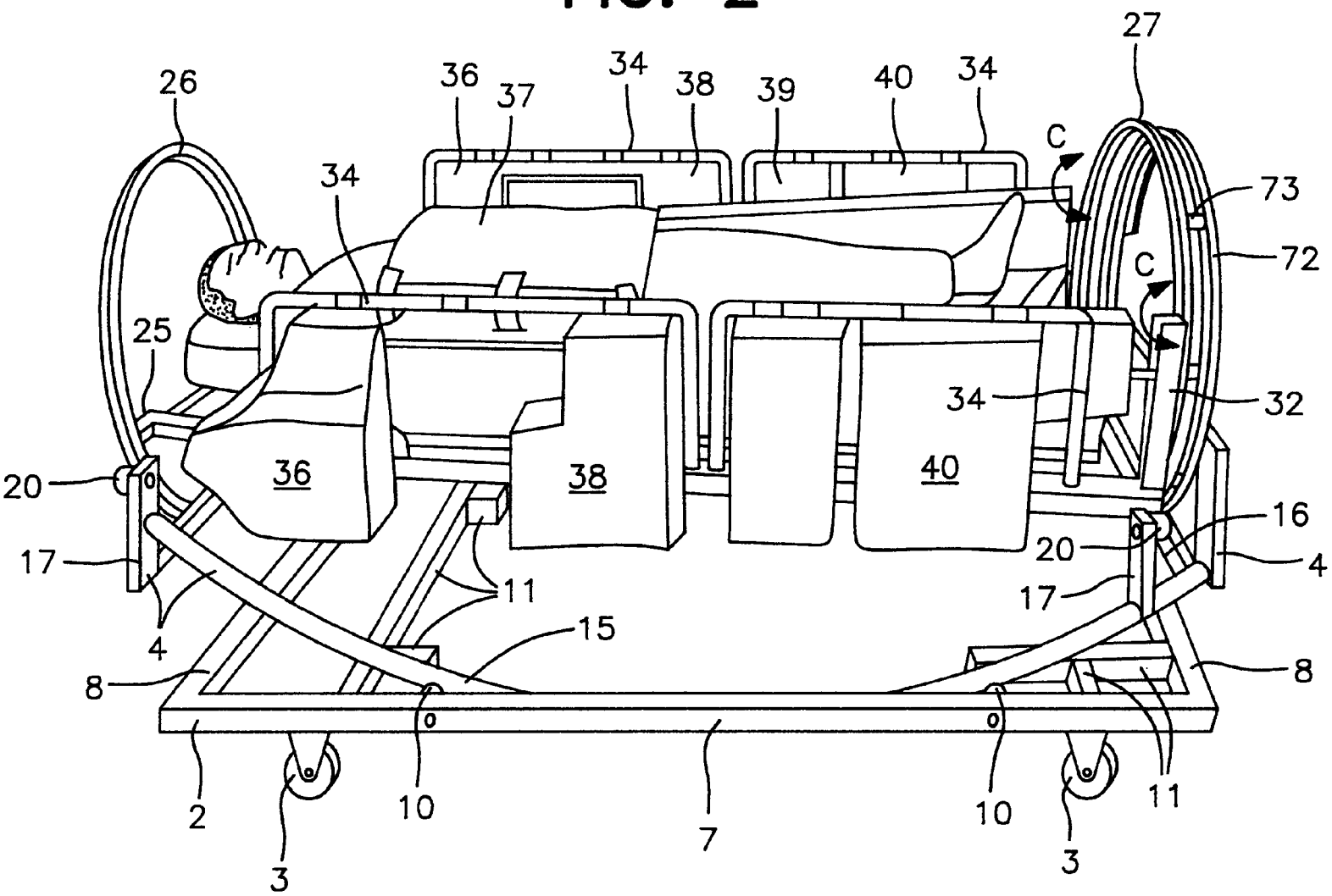
FIG. 2 is a more detailed perspective view of the bed of FIG. 1 with a patient in position on the bed.
Figure 3:
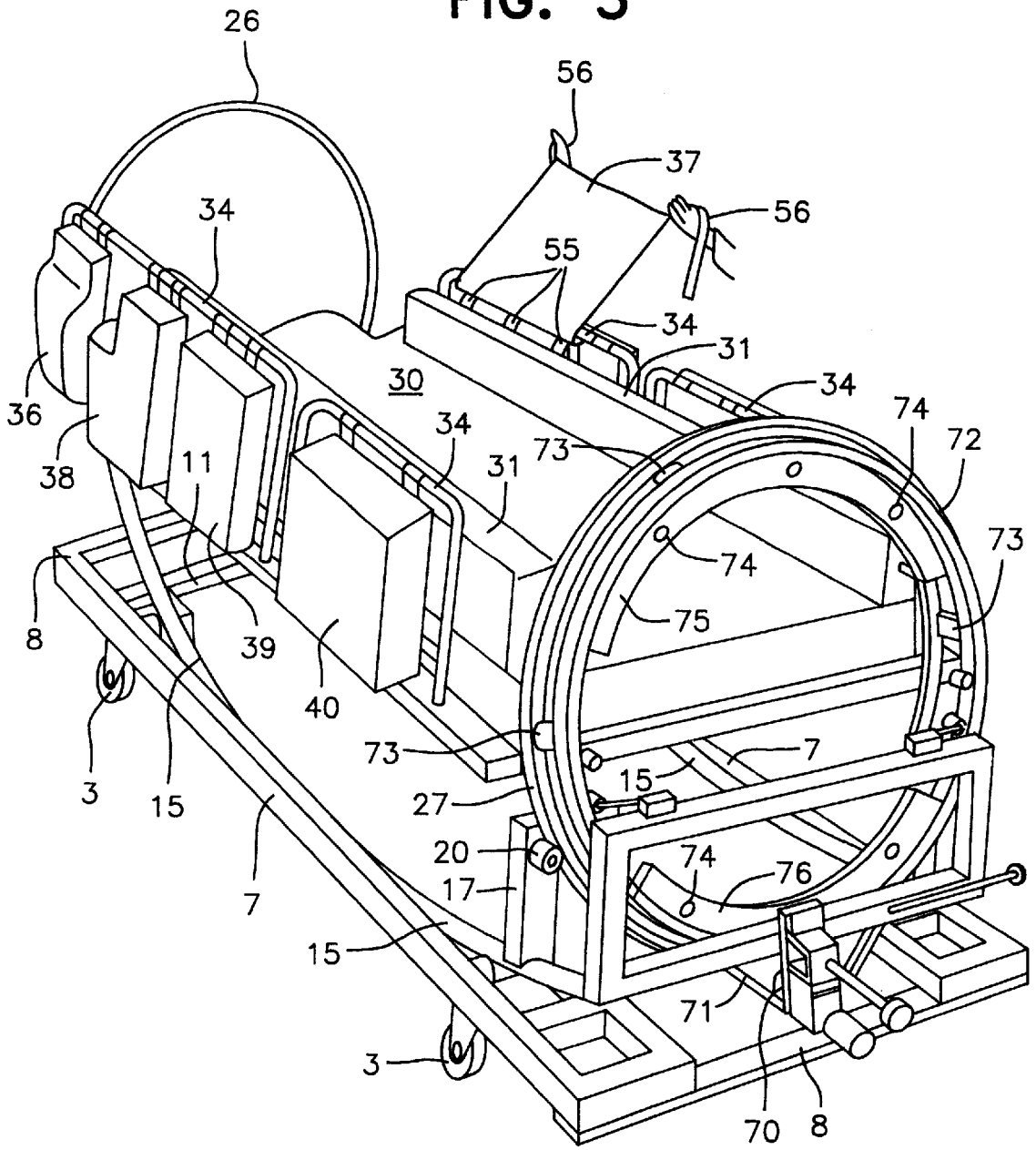
FIG. 3 is a perspective view of the bed without a patient in position.

Referring to the drawings there is illustrated a therapeutic bed according to the invention and indicated by the reference numeral 1. The bed 1 comprises a base framework which in this case comprises a castor frame 2 with castors or wheels 3, and a support Trendelenburg framework 4 mounted on the castor frame 2. A patient support platform 5 is mounted on the Trendelenburg framework 4.

In more detail, the castor framework 2 comprises a pair of longitudinal side members 7 interconnected by a pair of transverse members 8 to form a generally rectangular shaped framework. Trendelenburg roller guide means in the form of guide rollers 10 are rotatably mounted on roller support members 11 fixed to the castor framework 2. The Trendelenburg guide rollers 10 may be driven by a Trendelenburg motor (not shown).

The Trendelenburg framework 4 includes a curved arm means provided by a pair of longitudinally extending transversely spaced-apart curved Trendelenburg arms 15 which are engagable with the Trendelenburg guide rollers 10 for Trendelenburg movement in the direction of the arrows A in FIG. 1 about a transverse axis of rotation. The Trendelenburg arms 15 are interconnected at the head and foot ends of the bed 1 by cross members 16 with upright brackets 17. At an upper end of each of the upright brackets 17 a roller wheel 20 is mounted to define guide means on which the patient support platform 5 is rotatably mounted for movement about a longitudinal axis in the direction of the arrows B.

The patient support platform 5 comprises an outer patient support framework 22 and a mattress support 21 mounted to the framework 22.

The patient support platform 5 is mounted by support brackets 25 forming extensions of the support framework 22 to rail means defined by rings 26, 27 at opposite ends of the bed. The rings 26, 27 run along the engagement means defined by the roller guide wheels 20 on rotation of the patient support platform 5 in the direction of the arrows B.

Using a drive arrangement of the type described in our WO96/27356A (the details of which are incorporated by reference) to achieve kinetic therapy the patient support platform may be driven to achieve rotation of from ±15° to ±62° in the direction of the arrows B. This may be accompanied, by Trendelenburg motion in the direction of the arrows A.

Figure 8:
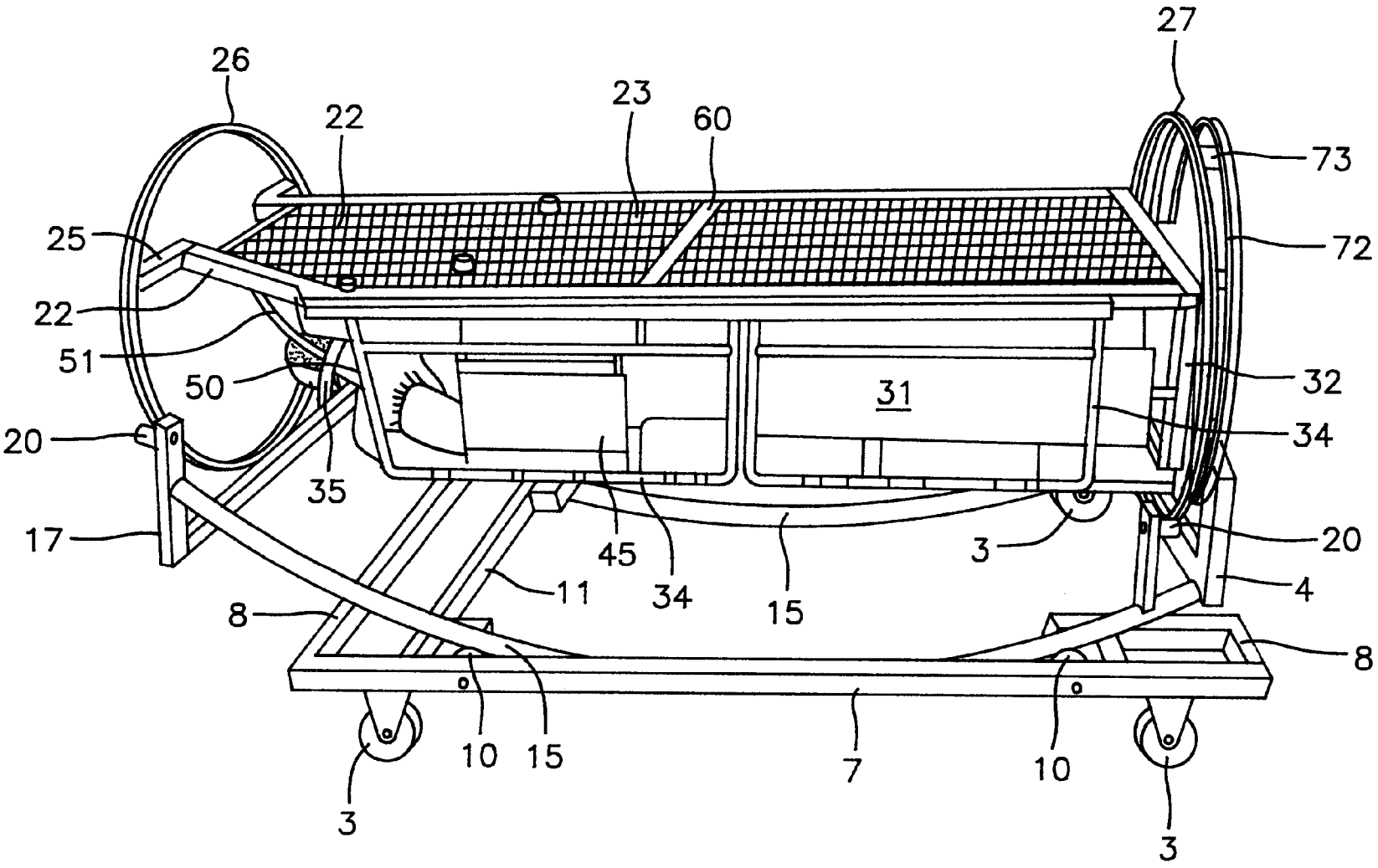
FIG. 8 is a side perspective view of the bed in another position of use.
Figure 9:
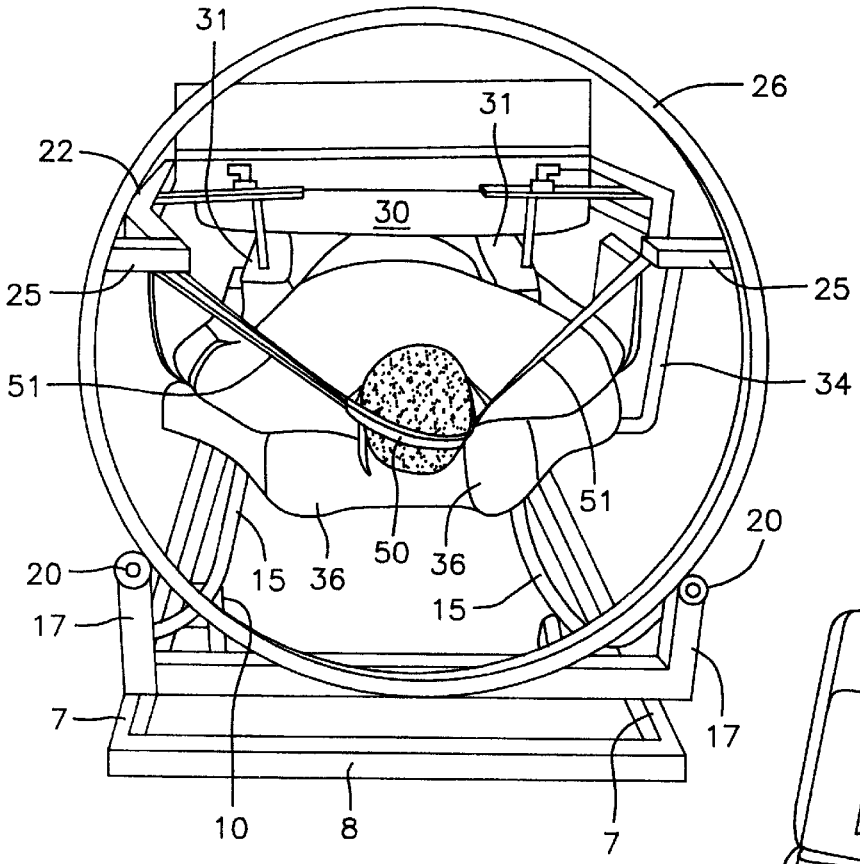
FIG. 9 is an end view from a head end of the bed of FIG. 8.
Figure 10:
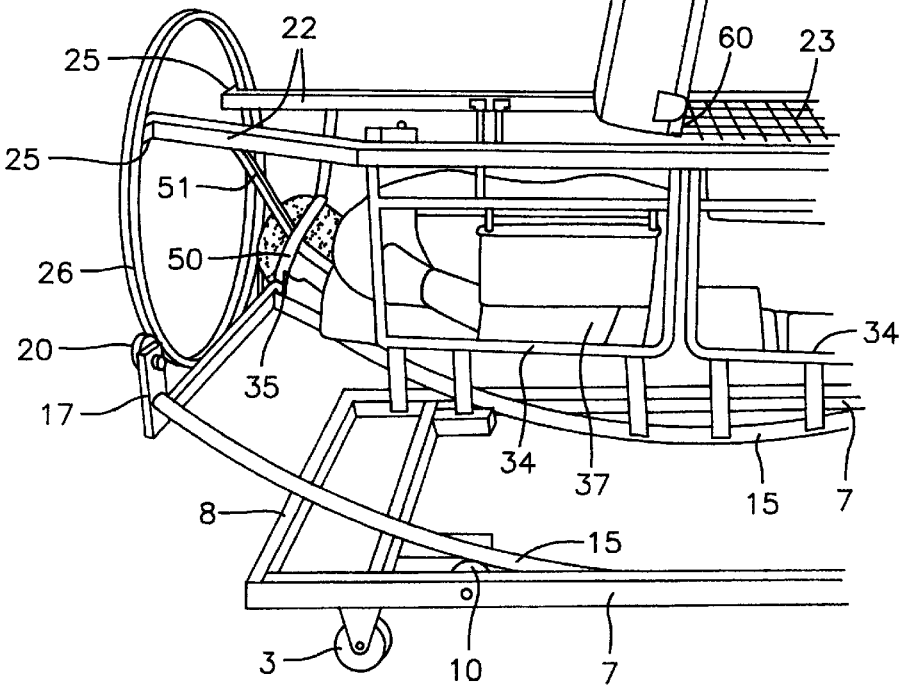
FIG. 10 is a side perspective view of a head end of the bed of FIG. 8.

In this case, in addition to kinetic therapy or indeed in some cases without kinetic therapy the patient support platform 5 may be driven from a patient face-up or supine position as illustrated in FIGS. 1 to 6 to a patient face-down or prone position as illustrated in FIGS. 8 to 10.

Supine patient support means is defined in this case by a mattress 30 mounted on the mattress support 23 and a pair of side pads 31 extending upwardly from the mattress 30. The side pads 31 are pivotally mounted in brackets 33 at a foot end of the bed. An abduction pack may also be provided to retain the patient's legs in a desired position. Details of such pads and their adjustment are given in EP315438A which is incorporated herein for reference.

Figure 4:
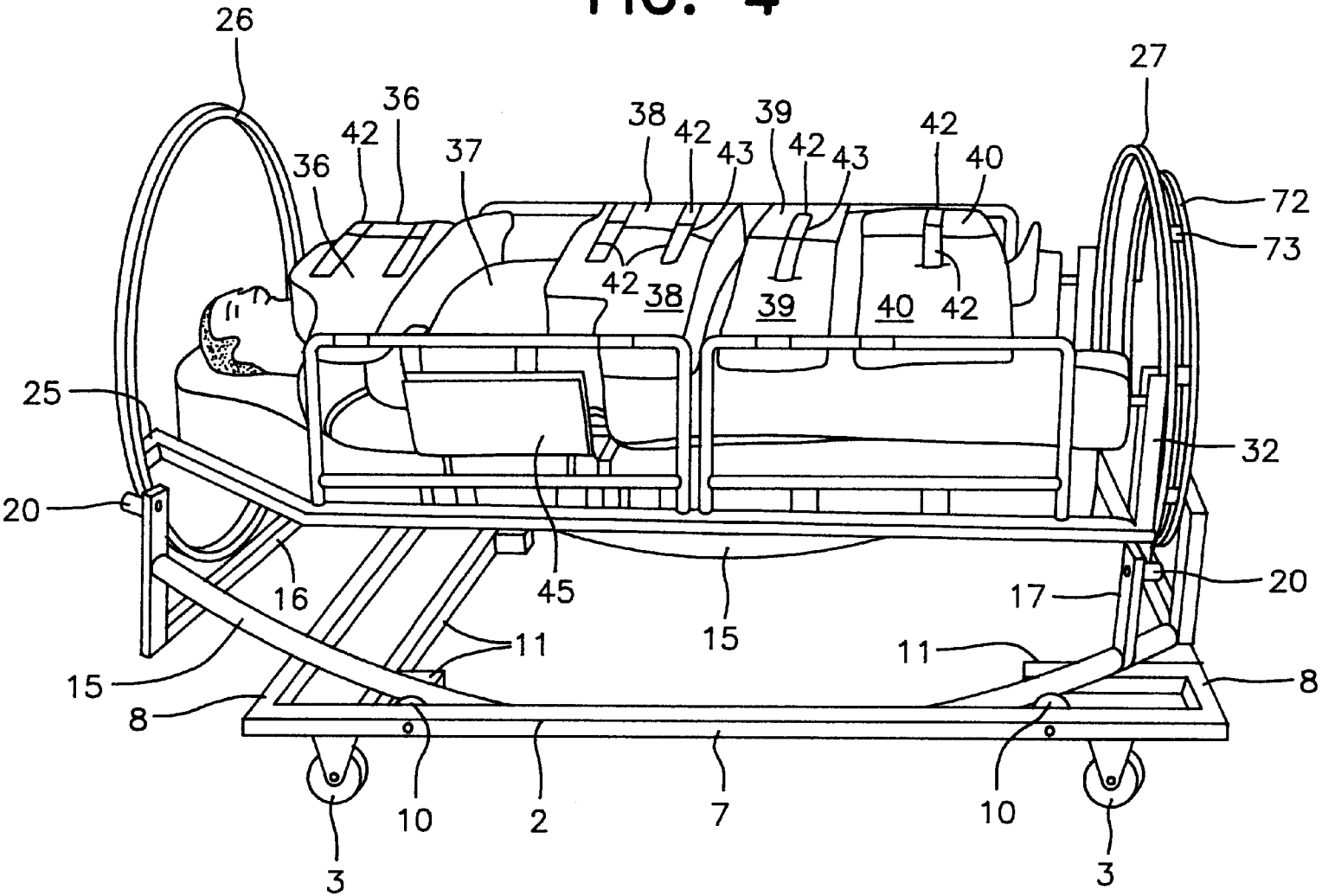
FIG. 4 is a perspective view similar to FIG. 3 with a patient in position.
Figure 5:
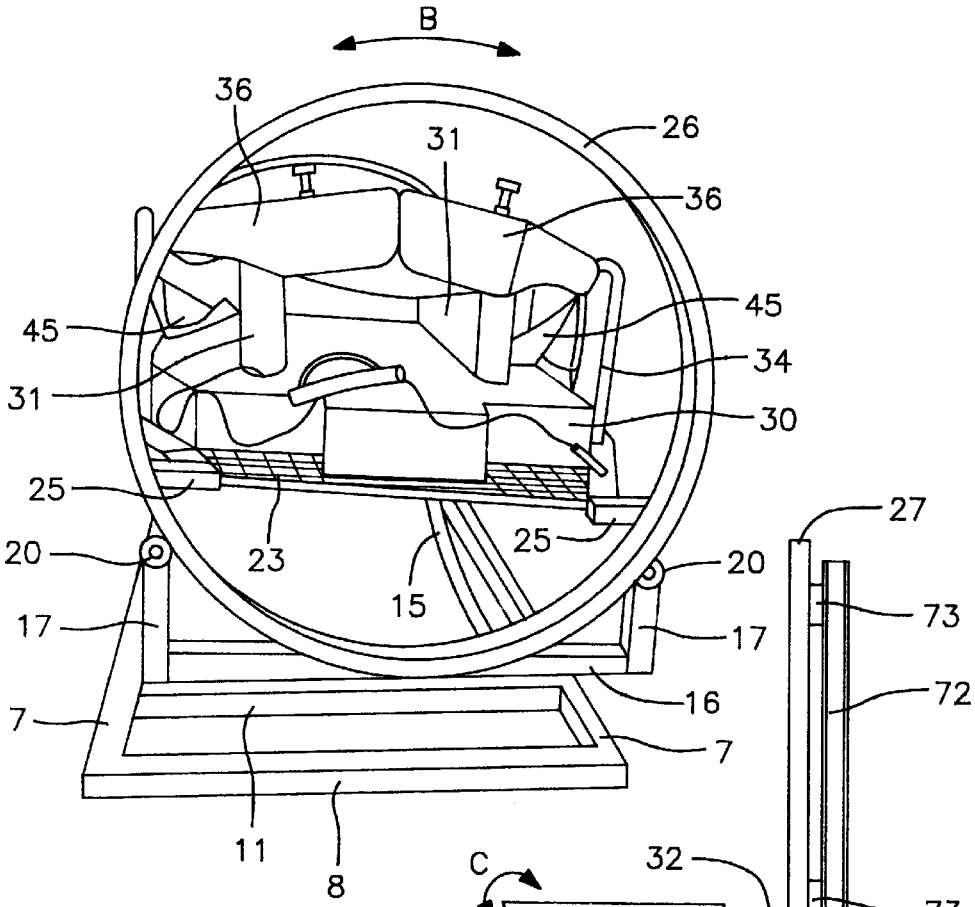
FIG. 5 is a view from a head end of the bed of FIG. 4.
Figure 7:
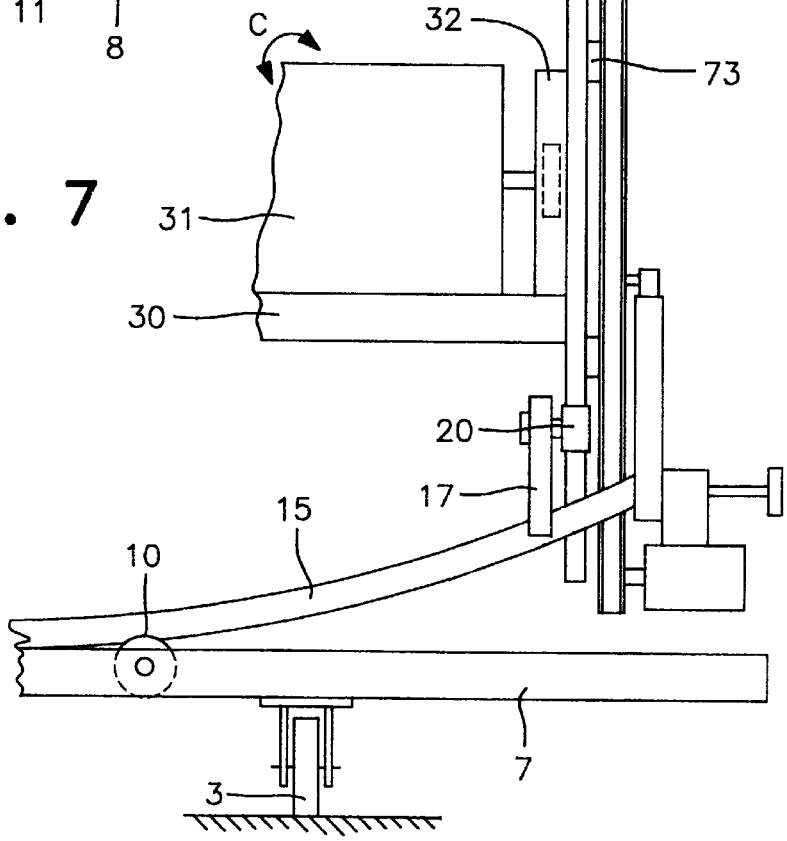
FIG. 7 is a side view of part of the bed.

Opposite side rails 34 are mounted to and extend upwardly from the outer patient support framework 22. Prone patient support means is in this case mounted on the side rails 34 for movement between the released position illustrated in FIGS. 2 and 3 to the engaged position illustrated in FIGS. 4 to 10. The prone support means comprises a number of sections defined by a head support 35, shoulder and upper body support sections 36, an abdomen support 37, and three lower body support sections 38, 39, 40. Each of the support sections 36, 38, 39, 40 are divided into opposite parts, each of which is hingedly mounted to the associated side rail 34 and are movable into the engaged position as illustrated in FIG. 4 and locked in this position by quick release locking fasteners 42 on locking belts or straps 43. Arm supports 45 also comfortably support a patient's arm in the prone position.

The head support 35 (FIGS. 8 and 9) is in the form of leather straps comprising a main head support strap 50 and connecting straps 51 extending to the mattress support framework.22. The headrest 35 including the straps 51 is adjustable to accommodate patients of varying size and to facilitate adjustment when a patient is in the prone position.

A patient's abdomen is in the prone position supported by the abdomen support 37 which consists of a length of flexible material, such a fabric material connected by straps 55 to one of the side pads 31 and by further adjustable straps 56 which are fixed to the opposite side pad 31. By adjusting the straps 55, 56 patients with different sized abdomens may be readily accommodated.

To facilitate access to the back of a patient when in the prone position it will be noted that the mattress support 23 is split transversely intermediate the ends thereof and is hingedly mounted at 60 for movement between release and engaged position as particularly illustrated in FIG. 9.

Figure 6:
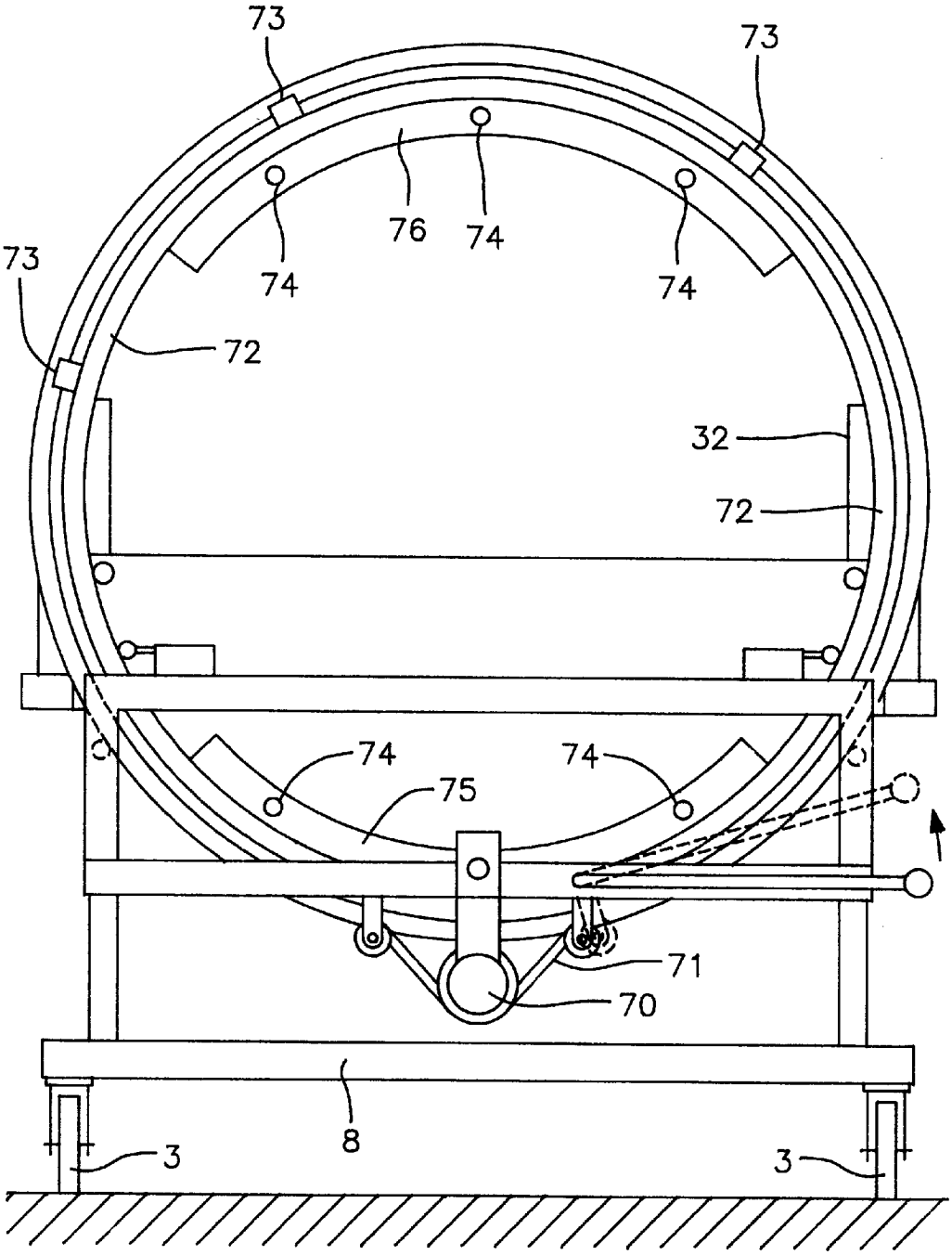
FIG. 6 is a view from a foot end of the bed of FIG. 4.

Referring particularly to FIG. 6 drive means for rotating the patient support platform 5 includes a combined electric motor and gearbox (not shown) having an output pulley 70 at the foot end of the bed. A drive belt 71 is trained over the output pulley 70 into an arcuate track which in this case is a ring-shaped track 72. The track 72 is in this case connected to the ring 27 by welding, bolting or by means of brackets 73. A locking pin (not shown) is inserted into the appropriate one of a number of receiving holes 74 on a patient supine locking pin receiver 75 for kinetic therapy when the patient is in the supine position or a patient prone locking pin receiver 76 when the patient is in the prone position. In this way the patient may be treated using kinetic therapy when the patient is in either the prone or supine positions.

Three different rotational movements of the patient support platform are possible. To achieve Trendelenburg and reverse Trendelenburg movement in the direction of the arrow A about a transverse axis of rotation a first drive motor (not shown) is used. This causes the patient support platform to swing about the transverse axis.

The second possible rotational movement is lateral rotation of the patient from ±15° to ±62° in the direction of the arrow B. Clinical practice has indicated the efficacy of this therapy, particularly in the treatment of patients with respiratory problems.

The operation of the bed to achieve kinetic therapy and Trendelenburg movement is described in U.S. Pat. No. 4,868,937 and WO96/27356A.

The most important movement in this case however is the rotation of the patient through a full 180° to allow the patient to be prone positioned. This is particularly applicable to patients with Adult Respiratory Distress Syndrome (ARDS). The mortality rate of such patients is in excess of 70% and the ability to prone position such patients as afforded by the therapeutic bed of the invention could determine their survival.

It will be appreciated that the rail means of the therapeutic bed of the invention may be provided by at least part of a rotatable barrel or cylinder.

It will also be appreciated that the support sections or parts of the prone patient support may be in more than one or two parts. There may be several parts which may be interconnected by a linkage.

It will be appreciated that the invention is applicable to therapeutic beds which are designed to achieve kinetic therapy alone and/or as a modification to achieve prone positioning of a patient.

It will also be appreciated that the prone patient support means of the invention may be applied to any construction of prone positioning bed or indeed to a prone patient support which is strapped to a patient and movable with the patient from a patient face-up or supine position to a patient face-down or prone position. The advantages of the prone patient support described above are primarily applicable to a specially designed therapeutic bed but may also be adapted to another bed or as a separate prone position unit.

The invention is not limited to the embodiments hereinbefore described which may be varied in both construction and detail.

I claim:

1. A therapeutic bed comprising:

a base framework, a patient support platform mounted on the base framework, guide rollers on one of the patient support platform and base framework for engagement with ring shaped rails on the other of the patient support platform and base framework for controlled rotational movement of the patient support platform relative to the base framework about a longitudinal axis of rotation of the patient support platform, the patient support platform being rotatable about the longitudinal axis through substantially 180° from a patient face-up or supine position to a patient face-down or prone position, the bed including prone patient support means for supporting the patient on the patient support platform when the patient support platform is in the prone position, the prone patient support means being mounted on the patient support platform for movement from a release position when a patient is in the supine position to an engaged position to support the patient in the prone position, the bed including a pair of side rails extending from the patient support platform and at least a portion of the prone patient support means being mounted on the side rails for movement between the release and engaged positions.

2. A therapeutic bed as claimed in claim 1, wherein the prone patient support means includes a number of sections which are mounted on the side rails for movement between the release and engaged positions.

3. A therapeutic bed as claimed in claim 2, wherein the prone patient support means includes opposite parts which are mounted on opposed side rails, the opposite parts being lockable in the engaged position to at least partially define the prone patient support means.

4. A therapeutic bed as claimed in claim 1, wherein the side rails are removable from the patient support platform.

5. A therapeutic bed as claimed in claim 4, wherein locking means are provided for locking the side rails to the patient support platform.

6. A therapeutic bed as claimed in claim 1, wherein the prone patient support means includes an abdomen support.

7. A therapeutic bed as claimed in claim 6, wherein the patient support platform includes a patient supine support means for supporting a patient on the patient support platform when the patient support platform is in a supine position and the abdomen support means is mounted on the patient supine support means for movement from a release position to an engaged position.

8. A therapeutic bed as claimed in claim 1 wherein the prone patient support means includes a head support.

9. A therapeutic bed as claimed in claim 1, wherein the patient support platform includes an outer frame and a mattress support mounted to the outer frame.

10. A therapeutic bed as claimed in claim 1 wherein the base framework comprises a castor frame and a Trendelenburg frame mounted on the castor frame, the patient support platform being mounted on the Trendelenburg frame and the Trendelenburg frame being mounted to the base frame for movement about a transverse axis of rotation.

* * * * *